United States Patent [19]

Roberts

[11] 4,257,341

[45] Mar. 24, 1981

[54] SPRING PRESSURE ADJUSTING TOOL FOR CAN CLOSING MACHINE

[76] Inventor: Jerry T. Roberts, 2255 Arrowwood Dr., Macon, Ga. 31206

[21] Appl. No.: 79,532

[22] Filed: Sep. 27, 1979

[51] Int. Cl.[3] ..... B21D 51/26

[52] U.S. Cl. ..... 113/7 R; 73/818

[58] Field of Search ..... 113/7 R, 54 R; 73/818; 29/407; 100/99

[56] References Cited

U.S. PATENT DOCUMENTS

| | | | |
|---|---|---|---|
| 3,404,564 | 10/1968 | Rapp | 73/818 X |
| 3,550,441 | 12/1970 | Dickinson | 73/818 |
| 3,786,676 | 1/1974 | Korolyshun et al. | 73/818 X |

*Primary Examiner*—Mark Rosenbaum

*Attorney, Agent, or Firm*—Newton, Hopkins & Ormsby

[57] ABSTRACT

A tool for use in a can closing or seaming machine to adjust the spring pressure exerted by the can holding chuck spring is disclosed. The tool permits chuck spring adjustment in conjunction with a force gage in situ without necessitating the removal of the gage from the machine for each spring incremental adjustment as is necessary in the prior art. The tool is a self-contained unit which includes an axially guidable and turnable wrench member, the tool also serving as an adapter or spacer for positioning the force gage in the machine.

11 Claims, 6 Drawing Figures

SPRING PRESSURE ADJUSTING TOOL FOR CAN CLOSING MACHINE

BACKGROUND OF THE INVENTION

In the operation of closing or seaming cans, such as 12 and 16 ounce beer cans, it is necessary to frequently check the spring pressure exerted on the can by a pressure spring provided in the can holding chuck of the machine. For example, the spring pressure must be checked and adjusted when changing can size and/or when cans formed of different materials, such as aluminum and steel, are being processed in the machine. Can closing machines of the type in question generally have twelve stations and it is a very tedious, time-consuming and expensive procedure to make the necessary spring pressure adjustments in accordance with prior art practice.

The prior art practice involves inserting between the seaming chuck adapter and the wear plate of the can holding adapter at each station of the machine a conventional mechanical force gage and a spacer or adapter for the gage. Every time an incremental adjustment of the pressure spring in the can holding chuck requires adjustment by means of a conventional allen screw wrench, it is necessary to remove the mechanical force gage and spacer and to reinsert the same in the machine in order to measure the spring pressure following adjustment. Several incremental adjustments may be required on the springs at each of the twelve machine stations. The required cumbersome and tedious procedure of removing and reinserting the mechanical force gage and its spacer at each station to allow each incremental spring adjustment is very impractical, slow and costly. The actual prior art procedure involves 14 separate steps.

The invention has for its object to greatly simplify the procedure for adjusting the spring pressure exerted on cans at the closing or seaming stations by providing a simple and efficient spring pressure adjusting tool which can be employed in situ along with a mechanical force gage, thus eliminating the repetitive use of a separate allen screw wrench, and the necessity for removing the force gage for each separate spring adjustment at each station of the machine, followed by reinserting the gage with its adapter or spacer.

The tool which embodies the present invention is a simple self-contained unit which takes the place of the prior art force gage spacer and has an axially guided and turnable built-in allen wrench stem which can be utilized in situ to rotate the spring pressure adjusting screw of the can holding chuck, the results of which spring adjustment can be directly read in situ on the mechanical force gage. The arrangement greatly simplifies the adjusting procedure and drastically reduces the time involved in making the necessary adjustments of spring pressure.

While no known prior art device exists for achieving the purposes of this invention, the following known domestic U.S. Pat. Nos. of mere general interest are made of record under 37 C.F.R. 1.56:

2,226,410
2,670,626
3,255,716
3,404,564
3,832,892
3,897,680

DETAILED DESCRIPTION

Figure 1:
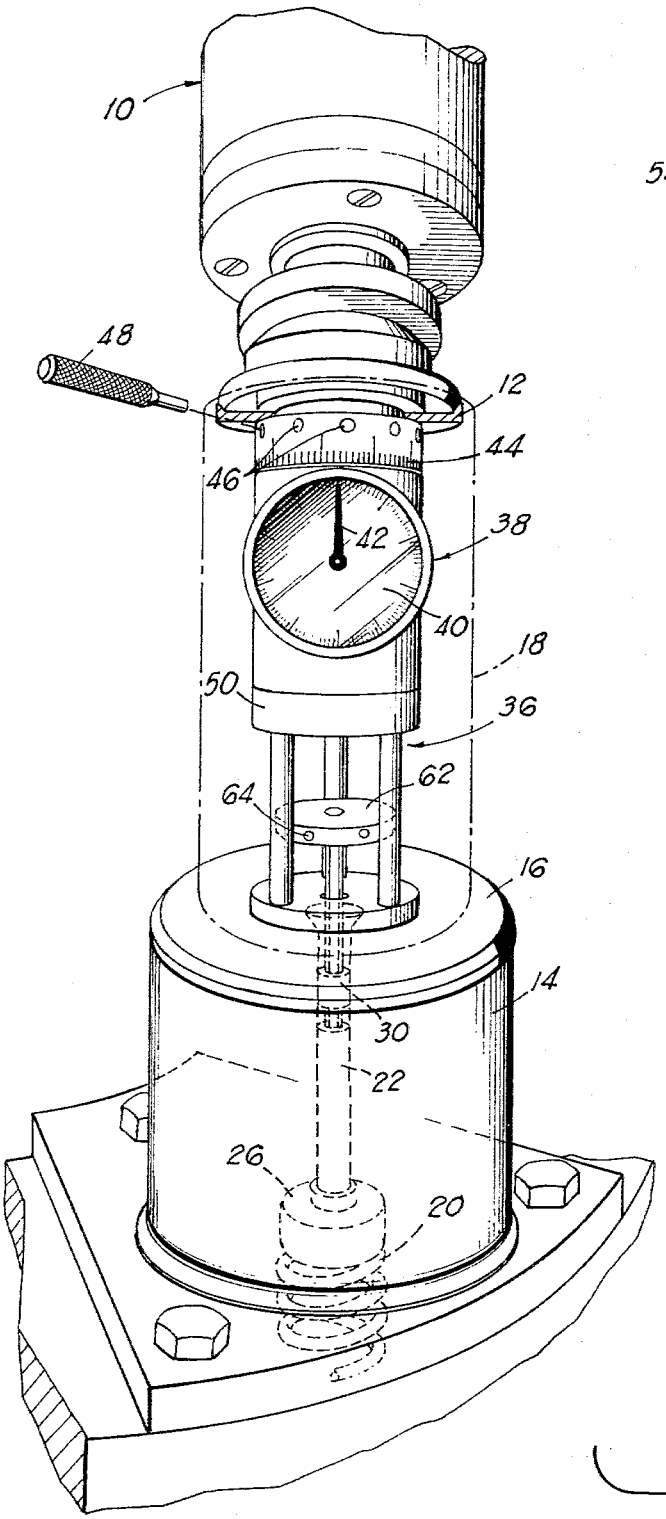
FIG. 1 is a fragmentary perspective view showing one of the twelve stations of a prior art can closing or seaming machine.
Figure 2:
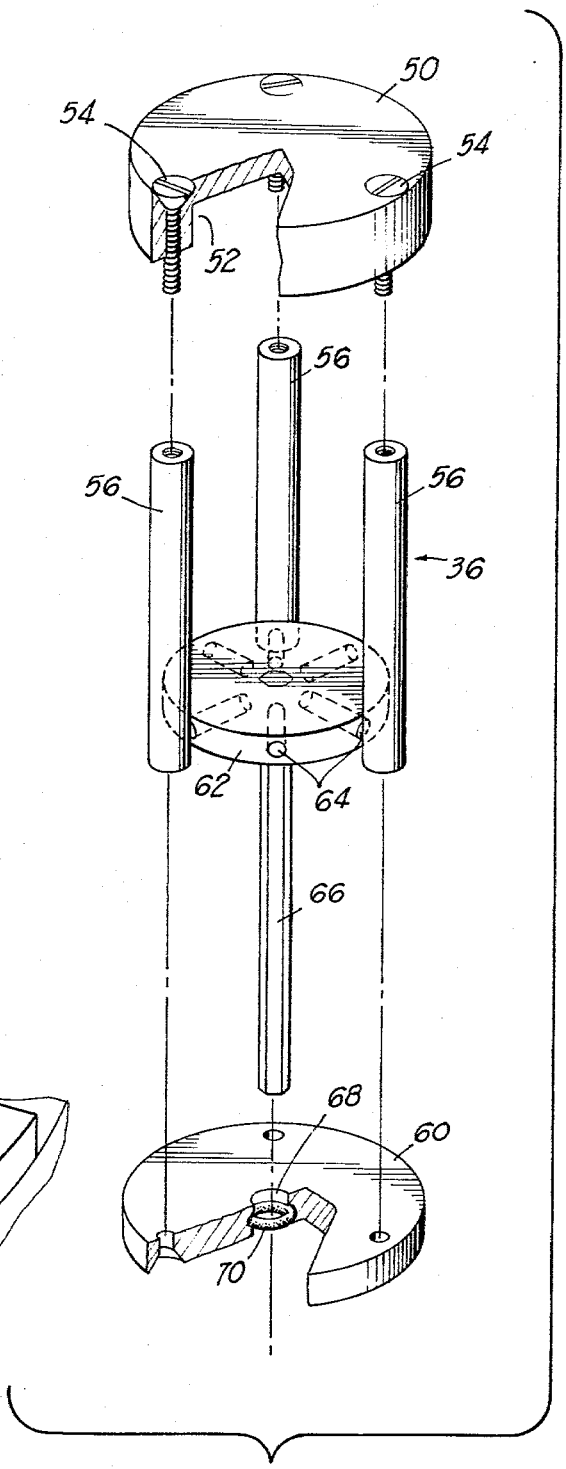
FIG. 2 is an exploded perspective view, partly in cross section, of a tool embodying the present invention according to one embodiment of the invention.

Referring to the drawings in detail wherein like numerals designate like parts, the numeral 10 designates one seaming spindle of a conventional twelve station can closing or seaming machine such as a machine designated 649 HCM-1, manufactured by Continental Can Company of Chicago, Ill. At each station of the machine, a seaming chuck adapter 12 associated with the spindle 10 is spaced above and is coaxial with a can holding chuck 14 of the machine having a wear plate 16 coupled thereto by a flat head screw, not shown. In the embodiment shown in FIG. 1, the machine station is arranged to process 16 ounce cans 18, such as beer cans, one such can being illustrated in phantom lines in FIG. 1. It will be understood that there is no can 18 in the machine when the spring pressure adjustment in accordance with the invention is being carried out, and FIG. 1 shows in solid lines the several components which are involved during the adjustment procedure.

Figure 3:
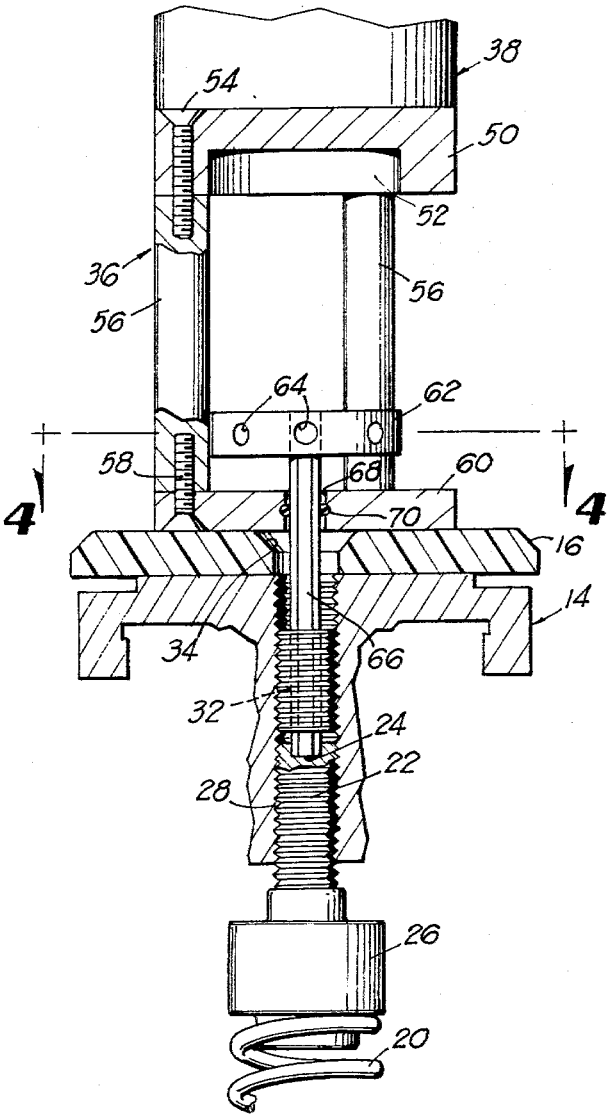
FIG. 3 is an enlarged fragmentary vertical section taken through the assembled tool of FIG. 2 and showing the use of the tool for adjusting the pressure spring of the can holding chuck in conjunction with a conventional mechanical force gage.
Figure 5:
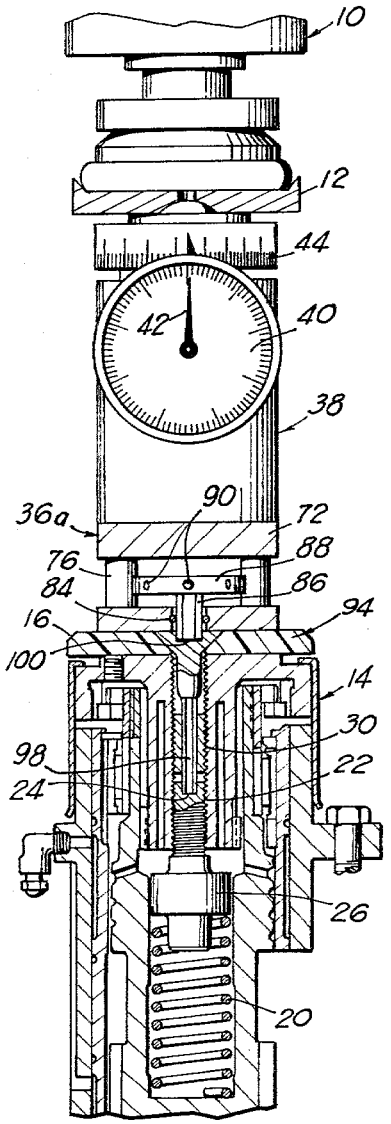
FIG. 5 is a fragmentary side elevation, partly in vertical cross section, and showing the spring pressure adjusting tool according to a second embodiment of the invention.
Figure 4:
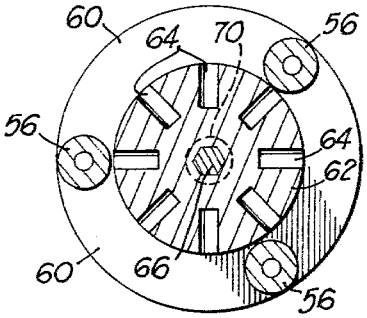
FIG. 4 is a horizontal section taken on line 4—4 of FIG. 3.

As shown in FIG. 1 and also in FIGS. 3 and 5, the conventional can seaming machine at each station thereof comprises a compression spring 20 which normally exerts a predetermined and rather critical pressure or force against the bottom of each can undergoing seaming. The pressure or tension of each spring 20 is adjusted by means of an adjusting screw 22 having an allen wrench socket 24 at its upper end and an enlarged spring seating head 26 at its lower end. The adjusting screw is contained in a threaded bore 28 of the can holding chuck 14 and in this same threaded bore, above the adjusting screw 22, is a locking screw 30 having an allen wrench opening 32 extending entirely therethrough axially and in alignment with the allen wrench socket 24 of adjusting screw 22. The threaded bore 28, FIG. 3, opens through the top face of can holding chuck 14 and registers with a central opening 34 of the wear plate 16, which opening normally receives a flat head screw serving to attach the wear plate to the chuck 14. The elements thus far described are all existing parts at each station of the conventional twelve station can seaming machine.

The spring pressure adjusting tool forming the main subject matter of this invention is indicated in its entirety at 36 in accordance with a first embodiment thereof where the spring 20 requires adjustment to exert the proper pressure on a 16 ounce can 18, for instance a can formed of aluminum. If a steel can of this size is employed, a different adjustment of the spring 20 will be required to exert a greater pressure on the can, and if a can of a different size, such as a 12 ounce can, is involved, a different adjustment of the spring 20 is required, as will be further described in connection with a second embodiment of the invention.

During spring adjustment, the tool 36 is employed in conjunction with the conventional mechanical force gage 38, such as a G-925 mechanical force gage, manufactured and sold by Force Control Company, Auburn Heights, Mich. The gage 38 has a force read-out face 40 which is suitably graduated to be read in conjunction with a movable pointer 42. A micrometer dial 44 on the force gage has a series of radial openings 46 to receive the tip of a gage loading wrench 48 in accordance with conventional practice.

Normally, in accordance with prior art procedure, the mechanical force gage 38 is employed together with an adapter or spacer, not shown, which occupies the space utilized by the tool 36 in FIG. 1. With the mechanical force gage and its spacer removed from the machine, each required incremental adjustment of the screw 22 is made by use of a conventional allen screw wrench whose stem is passed through the opening 32 of the locking screw 30 and into the socket 24 of the adjusting screw, after first using the allen wrench to back off the locking screw. Following each such adjustment, the mechanical force gage 38 and its spacer must be repositioned at the particular station of the machine and the gage is utilized in a known manner for checking the adequacy of the spring adjustment. If a further adjustment is required to meet specifications, then the mechanical force gage and its spacer must again be removed to allow such further adjustment with the separate allen wrench, following which the force gage and spacer must be repositioned in the machine for again measuring spring pressure. It is this tedious and time-consuming procedure which the use of the tool 36 obviates in the present invention.

The spring pressure adjusting tool 36 comprises an upper disc or head 50 having a bottom cavity 52 for a purpose to be described. The head 50 is secured by screws 54 to three circumferentially equidistantly spaced cylindrical legs 56, in turn secured at their lower ends by additional screws 58 to a bottom disc 60 adapted to rest on the wear plate 16 during use of the tool.

The three legs 56 surround and form a vertical guideway for a disc head 62 having plural circumferentially spaced radial turning openings 64, each adapted to receive the tip of loading wrench 48. Secured fixedly and dependingly to the disc head 62 at the center thereof is a straight hexagonal cross section allen type wrench bar 66 adapted to pass through the opening 34 of wear plate 16 and to engage in the allen wrench opening 32 of locking screw 30 and the allen wrench socket 24 of adjusting screw 22, as shown in FIG. 3.

The bottom disc 60 has a central aperture 68 formed therethrough provided with an elastic O-ring 70 which exerts a gripping force on the screw adjusting bar 66 so that the latter with its turning head 62 will be held at proper times in a fully elevated position with the disc head 62 located in the recess 52 of head 50. At such time, the lower end of bar 66 will be held above the bottom face of disc 60 and above the top face of wear plate 16 so that the entire tool 36 can be slid laterally from its position between the mechanical force gage 38 and the wear plate 16.

With the mechanical force gage 38 and adjusting tool 36 in place on the machine, as depicted in FIGS. 1 and 3, the required adjustment of the pressure exerted by spring 20 takes place as follows without the use of a separate allen wrench and without ever removing the force gage and tool 36 from the machine during the adjusting procedure. The connected head 62 and wrench bar 66 are moved downwardly so that the bar 66 can first enter the turning opening of locking screw 30. The elastic ring 70 will hold the bar 66 in any selected adjusted position. The loading wrench 48 is now engaged with one of the openings 64 and the head 62 is rotated with the bar 66 to slightly back off the locking screw 30. Following this, the wrench bar 66 is engaged in the socket 24 of adjusting screw 22 and the loading wrench 48 is again employed with one or more openings 64 to turn the wrench bar 66 for rotating and adjusting spring pressure screw 22 in the required direction. A direct read-out of the results obtained by turning the adjusting screw 22 can now be had in situ by conventional usage of the mechanical force gage 38. If the gage reading indicates that a further incremental adjustment of the screw 22 one way or the other is necessary, this may be accomplished in the described manner by use of the loading wrench 48 without removing the tool and/or mechanical force gage from the machine and without employing a separate allen wrench with the economies already discussed.

If preferred, in the above-described adjusting procedure, after removal of the retaining screw of wear plate 16, not shown, a separate conventional allen wrench can be used to back off the locking screw 30 in lieu of using the wrench bar 66 for this purpose.

While the operation of the mechanical force gage 38 is known in the art, it can be stated that when the force gage is put into place under seaming chuck adapter 12, its dial is already rotated to minimum gage height (shut height). Following the lowering of wrench bar 66 into engagement with the socket 24 of adjusting screw 22, the micrometer dial 44 of force gage 38 is rotated until solid contact is made, and using loading wrench 48, the micrometer dial is rotated to 0.035 inch deflection. Next, the actual load in pounds can be read on the indicator face 40 and the loading wrench 48 is used in one of the openings 64 to rotate the wrench bar 66 to thereby lower or raise the adjusting screw 22 to increase or decrease the pressure exerted by chuck spring 20. The resulting spring pressure will be indicated continually and directly on the indicator face 40.

Figure 6:
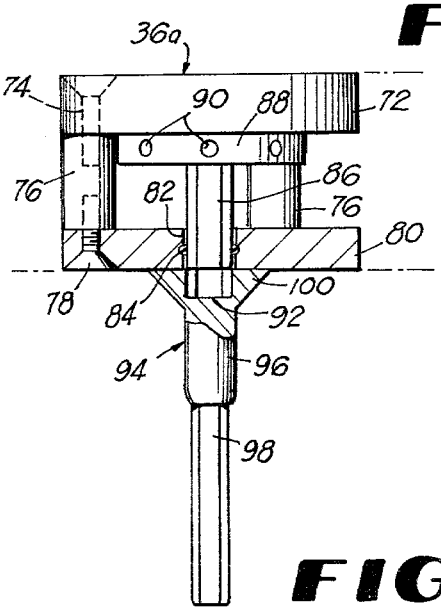
FIG. 6 is an enlarged side elevation of the tool in FIG. 5, partly in cross section.

FIGS. 5 and 6 show a second embodiment of the invention where the in situ spring pressure adjusting tool **36*a* is foreshortened and constructed for use in situations where the machine is processing 12 ounce beer cans or the like. In this situation, the seaming spindle 10 and seaming chuck adapter 12 have been lowered to accommodate the shorter height of the 12 ounce can. The identical mechanical force gage 38 is employed and therefore the in situ adjusting tool 36*a* must be shorter than the previously-described tool 36 for the longer 16 ounce cans. The tool 36*a* comprises a top disc or head 72 connected by screws 74 to three short circumferentially equidistantly spaced legs 76, in turn connected by screws 78 to a bottom disc 80 having a central through opening 82 equipped with an elastic O-ring 84 for a purpose already described. A foreshortened hexagonal wrench bar 86 is fixed to a disc head 88 having circumferentially spaced radial apertures 90 to receive the tip of loading wrench 48** in the manner previously-described.

The wrench bar 86 is of enlarged cross section compared to the bar 66 and after passing through the opening of disc 80 is adapted to enter a hexagonal socket 92 formed in a wrench bar extension 94 having the cylindrical stem 96 terminating in a hexagonal wrench bar portion 98 of the same cross sectional size as the wrench bar 66 in the prior embodiment. The extension 94 includes a conical head 100 adapted to be seated in the countersunk opening 34, FIG. 3, of wear plate 16.

As shown in FIG. 5, when the tool 36*a* is employed for the identical purpose described relative to the tool 36, the wrench bar portion 98 of extension 94 enters through the hexagonal opening of locking screw 30 and into the socket 24 of adjusting screw 22 in the manner already described under the first embodiment of the invention.

While the modes of use of tools 36*a* and 36 are essentially the same, there is a slight difference. Prior to placing the tool 36*a* in its use position, the wrench bar extension 94 must be inserted into the chuck 14. Following this and with the short wrench bar 86 retracted above the bottom face of disc 80, the tool 36*a* is slipped laterally into place, and the wrench bar 86 and attached disc head 88 are pushed down to the operative position shown in FIG. 5 where the wrench bar 86 is coupled drivingly with the extension 94. At this point, the loading wrench 48 is employed with apertures 90 to adjust in situ the pressure of spring 20 as required for 12 ounce cans. The adjustment is carried out in conjunction with the gage 38 in the exact manner previously described.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a can seaming machine, a seaming station including a seaming spindle and an associated seaming chuck adapter, an axially aligned can holding chuck including a wear plate spaced from the seaming chuck adapter, a pressure spring disposed in the can holding chuck and requiring adjustment of its tension, an adjusting screw in the can holding chuck associated with said spring and having a wrench socket, a locking screw in the can holding chuck to lock the adjusting screw and having a wrench through opening aligned with said socket, a mechanical force gage adapted for placement under said seaming chuck adapter, the improvement comprising an in situ adjusting tool to adjust the pressure of said spring and adapted for placement between said wear plate and mechanical force gage, said tool comprising top and bottom plate members, circumferentially spaced legs interconnecting the plate members, and a wrench bar including a turning head arranged guidingly inside of said legs with the wrench bar depending centrally from said turning head and being received through an aperture in said bottom plate member, whereby downward movement of said wrench bar and said turning head and subsequent rotation of the turning head enables the rotation of said spring pressure adjusting screw in situ.

2. In a can seaming machine as defined in claim 1, said wrench bar being of sufficient length to project through a central opening in the wear plate and through said locking screw through opening and into said socket of said adjusting screw, and said turning head being provided with spaced radiating openings adapted selectively to receive a turning implement.

3. In a can seaming machine as defined in claim 2, and an elastic ring element within said aperture of said bottom plate member of the adjusting tool grippingly engaging said wrench bar.

4. In a can seaming machine as defined in claim 3, and said top plate member of the tool having a bottom recess to receive said turning head of the wrench bar when the lower end of the wrench bar is elevated above the lower face of the bottom plate member and is held elevated by the gripping action of said elastic ring element.

5. In a can seaming machine as defined in claim 1, and a wrench bar extension adapted to be drivingly coupled with said wrench bar below said bottom plate member for effectively increasing the overall length of said adjusting tool.

6. In a can seaming machine as defined in claim 5, and said wrench bar extension comprising a head engageable within an opening of said wear plate, said head having a top opening wrench socket to drivingly receive said wrench bar immediately below said bottom plate member.

7. In a can seaming machine as defined in claim 1, and said legs comprising three equidistantly spaced cylindrical legs, and said turning head being cylindrical and having a periphery substantially tangent to the interior surfaces of said legs.

8. For use in a can seaming machine having adjustable tension pressure springs within can holding chucks of the machine which exert yielding pressure on corresponding ends of cans undergoing seaming, a spring pressure adjusting tool for placement between a chuck wear plate of the machine and a mechanical force gage comprising a top plate member, a bottom plate member, circumferentially spaced legs interconnecting the top and bottom plate members in assembled relationship, a wrench bar extending axially of said plate members and having a top turning head arranged captively and guidingly within said legs and having opening means to receive a turning implement, and said bottom plate member having a central aperture receiving said wrench bar rotatably and axially movably.

9. For use in a can seaming machine as defined in claim 8, and a friction element within the aperture of the bottom plate member grippingly engaging the wrench bar in all axially adjusted positions thereof, the top plate member of said adjusting tool having a bottom recess adapted to receive said turning head when the wrench bar is elevated to a position at least slightly above the bottom face of the bottom plate member.

10. For use in a can seaming machine as defined in claim 8, and said top turning head being cylindrical and having its periphery substantially tangent to the interiors of said legs, said legs being cylindrical and being equidistantly spaced circumferentially.

11. For use in a can seaming machine as defined in claim 8, and a wrench bar extension adapted to be drivingly coupled with said wrench bar below said bottom plate member.

* * * * *